US010644398B2

(12) United States Patent
Cheng et al.

(10) Patent No.: US 10,644,398 B2
(45) Date of Patent: May 5, 2020

(54) ANTENNA FOR GENERATING ARBITRARILY DIRECTED BESSEL BEAM

(71) Applicant: University of Electronic Science and Technology of China, Chengdu (CN)

(72) Inventors: Yujian Cheng, Chengdu (CN); Yichen Zhong, Chengdu (CN); Renbo He, Chengdu (CN); Yan Liu, Chengdu (CN); Yong Fan, Chengdu (CN); Kaijun Song, Chengdu (CN); Bo Zhang, Chengdu (CN); Xianqi Lin, Chengdu (CN); Yonghong Zhang, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 269 days.

(21) Appl. No.: 15/959,305

(22) Filed: Apr. 23, 2018

(65) Prior Publication Data

US 2019/0036214 A1 Jan. 31, 2019

(30) Foreign Application Priority Data

Jul. 28, 2017 (CN) ..... 2017 1 0629138

(51) Int. Cl.
*H01Q 3/26* (2006.01)
*H01Q 3/30* (2006.01)
(Continued)

(52) U.S. Cl.
CPC ..... *H01Q 3/30* (2013.01); *H01Q 3/14* (2013.01); *H01Q 3/46* (2013.01); *H01Q 13/02* (2013.01); *H01Q 19/06* (2013.01)

(58) Field of Classification Search
CPC ..... H01Q 3/26; H01Q 3/267; H01Q 3/2776; H01Q 3/30; H01Q 3/14; H01Q 3/46;
(Continued)

(56) References Cited

U.S. PATENT DOCUMENTS 8,498,539 B1 * 7/2013 Ilchenko ..... H04B 10/90 398/115
2013/0187830 A1 * 7/2013 Warnick ..... H01P 11/00 343/893
(Continued)

FOREIGN PATENT DOCUMENTS

CN 104466424 A 3/2015
CN 105609965 A 5/2016
CN 105846106 A 8/2016

*Primary Examiner* — Harry K Liu
(74) *Attorney, Agent, or Firm* — Bayramoglu Law Offices LLC

(57) ABSTRACT

An antenna for generating an arbitrarily directed Bessel beam, including a beam-forming plane and a feeding horn, the beam-forming plane is a dual-layer dielectric substrate structure having a beam focusing function, including: a printed circuit bottom layer, a high-frequency dielectric substrate lower layer, a printed circuit middle layer, a high-frequency dielectric substrate upper layer, and, a printed circuit upper layer; the printed circuit bottom layer, the high-frequency dielectric substrate lower layer, the printed circuit middle layer, the high-frequency dielectric substrate upper layer, and the printed circuit upper layer are co-axially stacked from the bottom to the top: the beam-forming plane is entirely divided into periodically arranged beam-forming units by a plurality of meshes, and each beam-forming unit consists of printed circuit upper, middle and lower metal patches of which centers are on the same longitudinal axis, the high-frequency dielectric substrate lower layer and the high-frequency dielectric substrate upper layer.

8 Claims, 7 Drawing Sheets

(51) Int. Cl.

| | |
|---|---|
| ***H01Q 3/46*** | (2006.01) |
| ***H01Q 3/14*** | (2006.01) |
| ***H01Q 13/02*** | (2006.01) |
| ***H01Q 19/06*** | (2006.01) |

(58) Field of Classification Search
CPC .... H01Q 13/02; H01Q 19/06; H01Q 21/0025; H01Q 25/00
USPC ..... 342/368
See application file for complete search history.

(56) References Cited

U.S. PATENT DOCUMENTS

| | | | | |
|---|---|---|---|---|
| 2014/0354498 | A1* | 12/2014 | Balma | H01Q 21/0006 343/771 |
| 2017/0158550 | A1* | 6/2017 | Genier | B23K 26/0676 |
| 2018/0353766 | A1* | 12/2018 | Casse | A61N 2/006 |

* cited by examiner

ANTENNA FOR GENERATING ARBITRARILY DIRECTED BESSEL BEAM

CROSS REFERENCE TO RELATED APPLICATIONS

This application is based on and claims priority to the Chinese patent application No. 201710629138.1, filed on Jul. 28, 2017, the entire contents of which are incorporated herein by reference.

TECHNICAL FIELD

The present invention relates to the field of electromagnetic wave beam forming, and particularly relates to an antenna for generating an arbitrarily directed Bessel beam.

BACKGROUND

The Bezier beam has a beam-propagating nature and can propagate for a considerable distance in a non-diffractive manner. The spatial beam propagation of electromagnetic waves has very important applications. In the fields of electromagnetic energy wireless transmission, THz-band space waveguide, near-field detection radar, microwave medical instruments, high-accuracy microwave measurement, and even ground-air power transmission of space solar energy, the spatial beam propagation of electromagnetic waves are required.

The Bessel beam has been extensively and deeply studied in the field of optics and microwave millimeter-wave electromagnetic fields. The Bessel beams can be generated by axicon lenses, holographic imaging, leaky wave antennas, and the like. It is noteworthy that all of the existing Bessel beams have beam pointing directions that are perpendicular to the radiating aperture of the antenna , and the beam pointing control and scanning cannot be achieved, which greatly limits the application scenario of the Bessel beam. For example, three different types of Bessel beam generating devices are disclosed by CN104466424A, CN105609965A, and CN105846106A, the beams generated by the three different types of Bessel beam generating devices are all perpendicular to the surface of the devices, and the beam pointing control and scanning cannot be achieved. Thus, it is desirable to design a new Bessel beam generating device with a simple structure, high efficiency, tiltable beam and controllable pointing.

SUMMARY

The purpose of the present invention is to provide an antenna for generating an arbitrary directed Bessel beam, aiming at the deficiencies of the background art, which has the advantages of simple structure, low manufacturing cost, controllable beam pointing, high bunching efficiency and high application frequency band.

In order to achieve the above mentioned objectives, the technical scheme of the invention is as follows:

An antenna for generating an arbitrarily directed Bessel beam, including a beam-forming plane and a feeding horn, the feeding horn faces a center of the beam-forming plane. The beam-forming plane is a dual-layer dielectric substrate structure having a beam focusing function, the beam-forming plane includes a printed circuit bottom layer, a high-frequency dielectric substrate lower layer, a printed circuit middle layer, a high-frequency dielectric substrate upper layer, and a printed circuit upper layer; the printed circuit bottom layer, the high-frequency dielectric substrate lower layer, the printed circuit middle layer, the high-frequency dielectric substrate upper layer, and the printed circuit upper layer are co-axially stacked from the bottom to the top. The beam-forming plane is entirely divided into periodically arranged beam-forming units by a plurality of meshes, and each beam-forming unit consists of printed circuit upper, middle and lower metal patches having centers on the same longitudinal axis, the high-frequency dielectric substrate lower layer, and the high-frequency dielectric substrate upper layer; the beam-forming unit is a basic unit having a function of electromagnetic wave phase shifting.

In principle, the beam-forming unit is equivalent to a low-pass phase filter with beam-forming effect. By setting the size of the three-layer metal patches in each beam-forming unit on the beam-forming plane, insertion phase shift of 0 degrees, −90 degrees, −180 degrees, and −270 degrees can be achieved anywhere on the beam-forming plane. Further, under the illumination of the feeding horn, a phase distribution that satisfies the Bessel distribution is generated on the exit surface of the beam-forming plane to generate the Bessel beam.

Preferably, the ideal phase shift amount φ(f) of the beam-forming units on the beam-forming plane is calculated by formulas (1) to (4):

$$\varphi_1(f) = 2\pi\frac{f}{c}\left[\sqrt{d^2+r^2} - d + \frac{(-r)\times(l\cos\theta - R)}{\sqrt{l^2+R^2-2lR\cos\theta}}\right] \tag{1}$$

$$r_s = \frac{l\cos\theta}{R}r \tag{2}$$

$$\varphi_2(f) = 2\pi\frac{f}{c}\left[\sqrt{(x-r_s)^2+y^2+\left(\frac{lr\sin\theta}{R}\right)^2} - \sqrt{(r-r_s)^2+\left(\frac{lr\sin\theta}{R}\right)^2}\right] \tag{3}$$

$$\varphi(f) = \mathrm{mod}[(\varphi_1+\varphi_2), 2\pi] \tag{4}$$

where, d is the distance between the phase center of the feeding horn and the center of the beam-forming plane; x and y are the coordinates of the center point of each mesh, $r=\sqrt{x^2+y^2}$ the distance between the center point of each mesh and the center of the beam-forming plane; φ(f) is the ideal phase shift amount of the beam-forming unit in each mesh; f is the operating frequency; c is the free-space speed of light; l is the non-diffractive distance of the Bessel beam; θ is the angle between the Bessel beam and the beam-forming plane; R is the radius of the beam-forming plane 1, and mod is the remainder function.

According to the different position (x, y) of each beam-forming unit, the ideal phase shift for each beam-forming unit on the beam-forming plane is calculated according to the formulas (1)-(4), then according to the ideal phase shift amount, the beam-forming unit is selected and arranged on the beam-forming plane, thus a phase distribution that satisfies a Bessel distribution on an exit face of the beam-forming plane is generated to generate bunched non-diffracted electromagnetic waves.

The beam pointing direction of the beam-forming non-diffracted electromagnetic wave depends on the parameter θ in the formulas, changing the value of θ in the design can achieve different-directed Bessel beams; the beaming range of the bunched electromagnetic wave depends on the parameter l in the formulas, changing the value of l in the design can achieve bunched electromagnetic waves of different depth of field (beaming range). The dielectric substrate should be a plate with low loss, low dielectric constant, and stable high frequency performance.

Preferably, sizes of the metal patches in the beam-forming unit corresponding to different phase shift amounts are obtained in a full wave simulation software through periodic boundary conditions.

Preferably, the meshes are rectangle or hexagon; when the meshes are rectangle, the beam-forming units are arranged in a square mesh, and when the meshes are hexagon, the beam-forming units are arranged in a honeycomb mesh. Each of the two mesh forms have the advantages that: when the mesh and the metal patch are rectangular, the feeding horn can generate the Bessel beams with different depth-of-field and different lobe widths when transmitting the horizontal or vertical polarized waves, respectively; when the mesh and the metal patch are hexagonal, the axial symmetry of the exit field will be improved, which can improve the Bessel beam generation efficiency to some extent.

Preferably, the printed circuit lower metal patch and the printed circuit upper metal patch have the same size in each beam-forming unit.

Preferably, the feeding horn can be a linearly polarized, circularly polarized or multi-polarized horn. The pyramid horn can be changed to a conical horn to improve the axial symmetry of the Bessel beam. The linearly polarized feeding horn can be changed to a circularly polarized or elliptically polarized feeding horn in order to generate circularly or elliptically polarized Bessel beam respectively.

Preferably, the second beam-forming plane can be arranged behind the beam-forming plane. The second beam-forming plane and beam-forming plane have the same structure, and are coaxially stacked; changing the relative angle of the beam-forming plane and the second beam-forming plane by rotating to achieve a scanning of beam pointing angel θ.

More preferably, the beam-forming plane and the second beam-forming plane have the same structure. However, the only difference between the beam-forming plane and the second beam-forming plane is that distribution of the beam-forming units in the printed circuit bottom layer, the printed circuit middle layer and the printed circuit upper layer on the second beam-forming plane are different. The ideal phase shift amount φ(f) of the beam-forming unit in the mesh divided by the second beam-forming plane is calculated by formulas (5) to (8):

$$\varphi_1(f) = \frac{2\pi \times f \times (-r) \times (l\cos\theta - R)}{c \times \sqrt{l^2 + R^2 - 2lR\cos\theta}} \tag{5}$$

$$r_s = \frac{l\cos\theta}{R} r \tag{6}$$

$$\varphi_2(f) = 2\pi \frac{f}{c} \left[ \sqrt{(x - r_s)^2 + y^2 + \left(\frac{lr\sin\theta}{R}\right)^2} - \sqrt{(r - r_s)^2 + \left(\frac{lr\sin\theta}{R}\right)^2} \right] \tag{7}$$

$$\varphi(f) = \mathrm{mod}[(\varphi_1 + \varphi_2), 2\pi] \tag{8}$$

where, x and y are the coordinates of the center point of each mesh, so $r=\sqrt{x^2+y^2}$ is the distance between the center point of each mesh and the center of the beam-forming plane; φ(f) is the ideal phase shift amount of the beam-forming unit in each mesh; f is the operating frequency; c is the free-space speed of light; l is the non-diffractive distance of the Bessel beam; θ controls the beam scanning range, θ/2 is the minimum value of angle between the Bessel beam and the beam-forming plane during the scanning; R is the radius of the beam-forming plane 1, and mod is the remainder function.

Thus, according to a different mesh position (x, y) of each beam-forming unit, the ideal phase shift of each beam-forming unit on the second beam-forming plane is calculated by the formulas (5)-(8), then, according to the ideal phase shift amount, a suitable sized beam-forming unit is selected and arranged on the second beam-forming plane to obtain a final design structure of the second beam-forming plane.

The beam scanning is achieved by rotating the beam-forming plane and the second beam-forming plane. Changing the rotation angle a can generate non-diffracted beams with different inclination angles β along the X-axis, as shown in FIG. 6 and FIG. 8. The corresponding relationship between the rotation angle a and the inclination angles β is shown in Table I.

TABLE I

The corresponding relationship between the rotation angle α and the inclination angles β

| | α | | | | | | |
|---|---|---|---|---|---|---|---|
| | 90° | 75° | 60° | 45° | 30° | 15° | 0° |
| β | 0° | 15° | 30° | 45° | 53° | 62° | 65° |

Compared with the prior art, the present invention has the following advantages:

1. The present invention adopts a beam-forming technology and adopts only an ordinary PCB (Print Circuit Board) process, the beam-forming plane is only about 1 millimeter thick , and the weight is reduced by more than 90% as compared with the realization of an ordinary lens.
2. The non-diffractive beam can achieve any angle scanning with a pitch angle of--65°–65° and an azimuth angle of 0°-360°, and the beam's depth of field can be set arbitrarily.
3. In terms of realization effect, the dielectric loss is almost negligible due to the extremely thin thickness of the beam beam-forming plane.
4. The mature PCB process applied in the invention can achieve higher processing precision than the lens process, and can be applied to higher frequency bands than the existing technology, and can avoid the considerable processing errors of lens introduced by machining. The mature PCB process is a low-cost solution suitable for mass production and has unique advantages on the implementation of the Bessel beam, especially in the millimeter-wave band.
5. Compared with various Bessel beam antennas adopting the aperture antenna preparation method, the present invention has a simpler structure without the complicated feeding structure, and avoids the transmission loss and the mismatch loss in the feed network.
6. In the modified version of the present invention, the two beam-focusing planes rotate in the opposite direction by the same angle, so that only one drive motor and one reverser can achieve beam-pointing scanning.

1 is the beam-forming plane; 2 is the feeding horn; 3 is the second beam-forming plane; 12 is the printed circuit upper layer; 111 is the high-frequency dielectric substrate upper layer; 13 is the printed circuit middle layer; 112 is the high-frequency dielectric substrate lower layer; 14 is the printed circuit bottom layer; 121 is the printed circuit upper metal patch; 131 is the printed circuit metal patch; 141 is the printed circuit lower metal patch; 15 is the mesh that is divided.

DETAILED DESCRIPTION OF THE EMBODIMENTS

The present invention will be described below with reference to specific embodiments. Those skilled in the art can easily understand the advantages and effects of the present invention by the contents disclosed in the embodiments. The present invention may also be implemented or applied through other different specific embodiments. The various details in this embodiment can also be modified or changed on the basis of different opinions or applications without departing from the spirit of the present invention.

Embodiment 1

Figure 1:
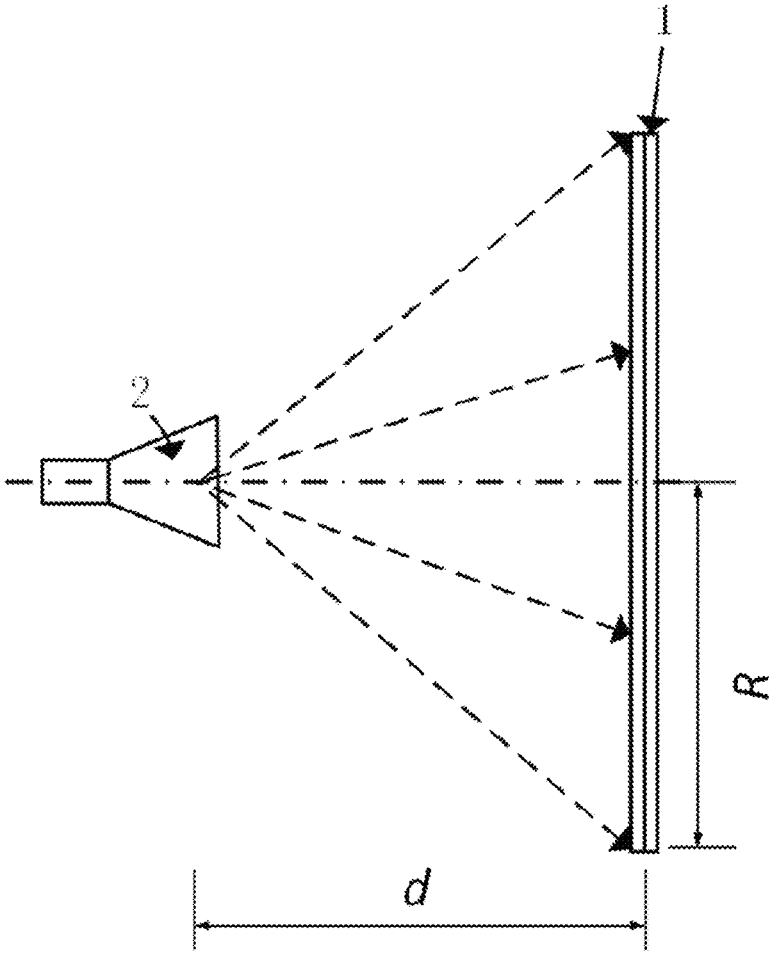
FIG. 1 is a side view of the antenna according to the present invention.
Figure 2:
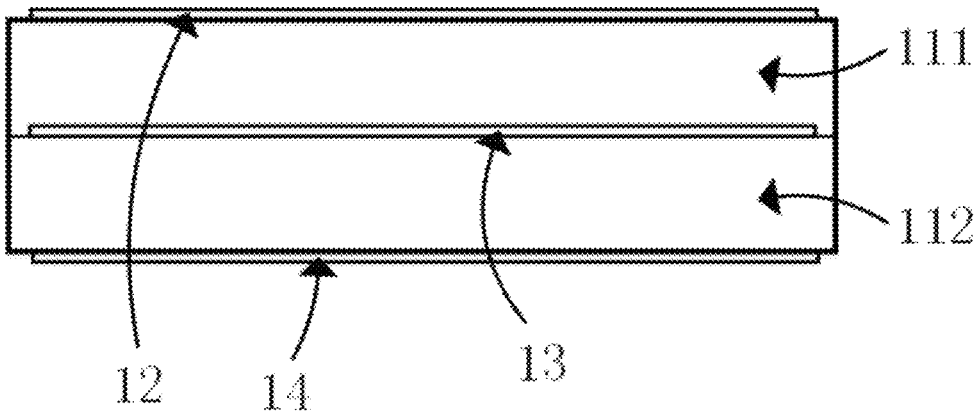
FIG. 2 is a side view of the beam-forming plane according to the present invention.
Figure 3:
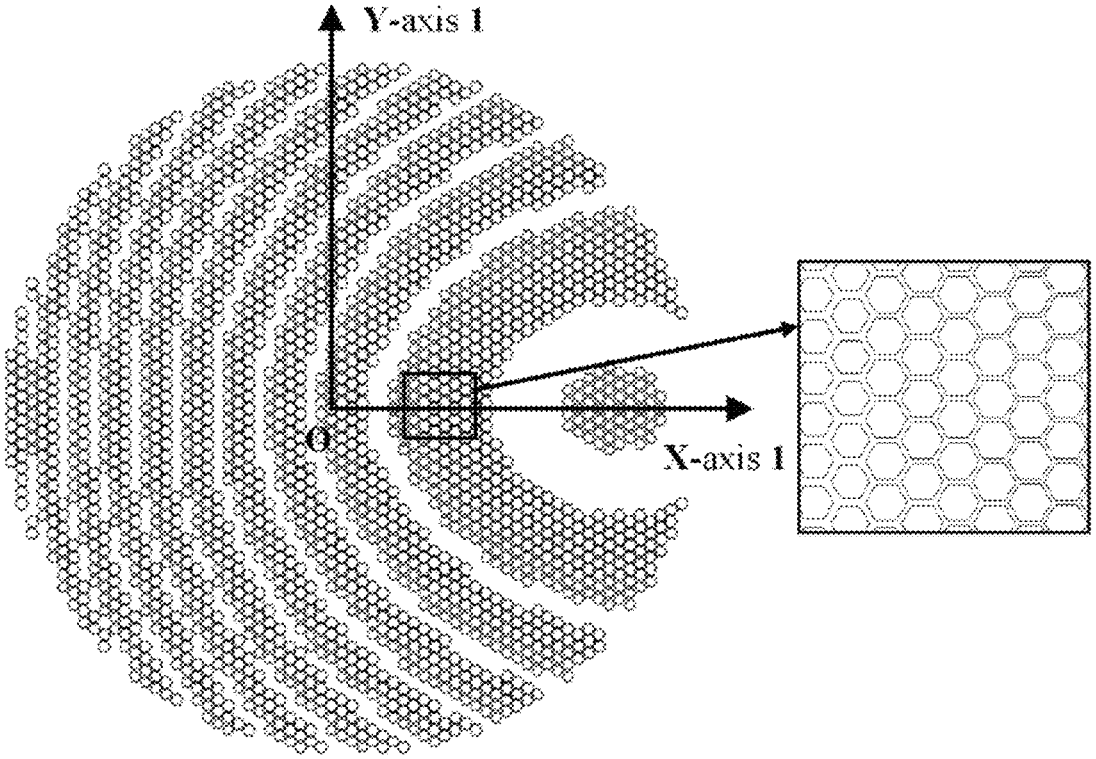
FIG. 3 is a front view of the beam-forming plane according to the present invention.
Figure 4:
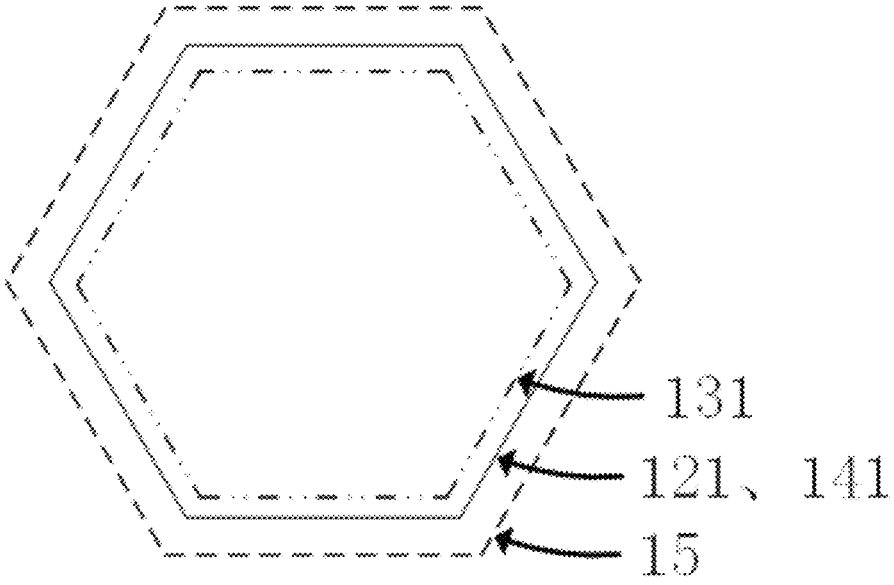
FIG. 4 is a front view of the beam-forming unit on the beam-forming plane according to the present invention.
Figure 5:
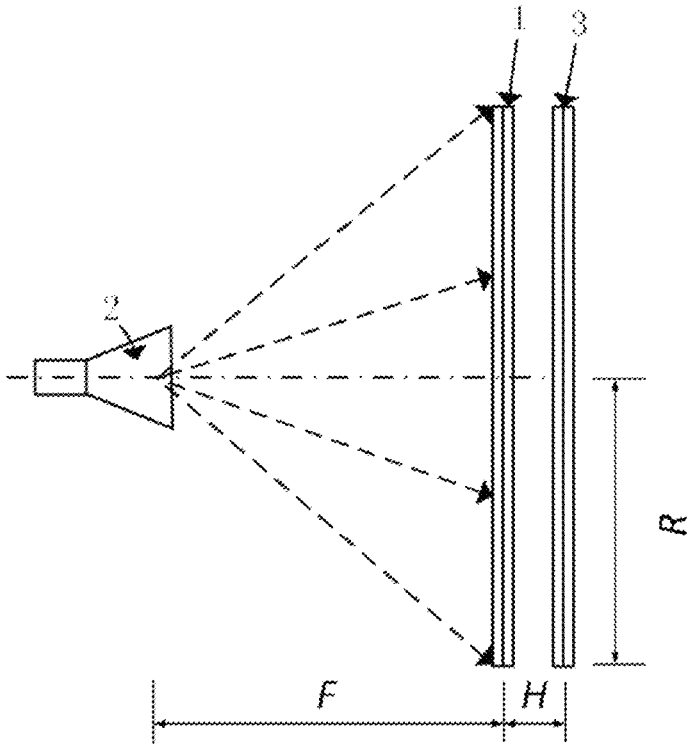
FIG. 5 is a side view of the antenna according to Embodiment 2 of the present invention.

An antenna for generating an arbitrarily directed Bessel beam, includes a beam-forming plane 1 and a feeding horn 2. The feeding horn 2 faces the center of the beam-forming plane 1, as shown in FIG. 1. The beam-forming plane 1 transforms the quasi-spherical wave emitted from the feeding horn 2 into the non-diffracting beam-forming beam (Bessel beam). The beam-forming plane 1 is a dual-layer dielectric substrate structure having a beam focusing function as shown in FIG. 2, including a printed circuit bottom layer 14, a high-frequency dielectric substrate lower layer 112, a printed circuit middle layer 13, a high-frequency dielectric substrate upper layer 111, and a printed circuit upper layer 12; the printed circuit bottom layer 14, the high-frequency dielectric substrate lower layer 112, the printed circuit middle layer 13, the high-frequency dielectric substrate upper layer 111, and the printed circuit upper layer 12 are co-axially stacked from the bottom to the top. The high-frequency dielectric substrate lower layer 112 and the high-frequency dielectric substrate upper layer 111 are circular substrates with a diameter of 200 mm, and are closely combined by multilayer printed circuit board process. Both, the high-frequency dielectric substrate lower layer 112 and the high-frequency dielectric substrate upper layer 111, have a dielectric constant of 2.2 and a thickness of 0.508 mm. The entire beam-forming plane is divided into periodically arranged beam-forming units by a plurality of meshes. In the present embodiment, the mesh 15 is a regular hexagonal mesh with a side length of 2 mm, and the division of the meshes is to facilitate the arrangement of the beam-forming units and does not actually appear on the beam-forming planes. The hexagonal beam-forming units are arranged in the honeycomb meshes in order respectively. The hexagonal metal patch 121, 131, 141 is set in the center of each mesh and each beam-forming unit consists of printed circuit upper, middle and lower metal patches 121, 131, 141 having centers on the same longitudinal axis, the high-frequency dielectric substrate lower layer 112, and the high-frequency dielectric substrate upper layer 111. The beam-forming unit is a basic unit having a function of electromagnetic wave phase shifting, the printed circuit lower metal patch 141 and the printed circuit upper metal patch 121 have the same size. The metal patch is the rest of the copper substrate after etching the original surface of the dielectric substrate using a multilayer printed circuit board technology, as shown in FIG. 3. The metal patches are located at the center of each divided regular hexagonal mesh and the edges of the metal patches are parallel to the regular hexagonal mesh, as shown in FIG. 4.

In principle, the beam-forming unit is equivalent to a low-pass phase filter with beam-forming effect. By setting the size of the three-layer printed metal patches in each beam-forming unit on the beam-forming plane, insertion phase shift of 0 degrees, −90 degrees, −180 degrees, and −270 degrees can be achieved anywhere on the beam-forming plane. Further, under the illumination of the feeding horn, a phase distribution that satisfies the Bessel distribution is generated on the exit surface of the beam-forming plane to generate the Bessel beam.

In this Embodiment, the radius R of the beam-forming plane is 100 mm, the operating frequency f is 29 GHz, the free space speed of microwave c is $3\times10^8$ m/s, the high-frequency dielectric substrate lower layer 112 and the high-frequency dielectric substrate upper layer 111 are Taconic TLY-5 dielectric plates, and have a dielectric constant $\varepsilon_r$ of 2.2 and a thickness of 0.508 mm. The feeding horn 2 is a standard pyramid horn with a −10 dB lobe width of 60 degrees. The distance d between the phase center of the feeding horn 2 and the center of the beam-forming plane is 173 mm. Beam-forming beam design in this embodiment has a beam length Zmax of 850 mm, and the angle θ between the beam and the beam-forming plane is 60 degrees.

Thus, the ideal phase shift amount φ(f) of the beam-forming units on the beam-forming plane is calculated by formulas (1) to (4):

$$\varphi_1(f) = 2\pi\frac{f}{c}\left[\sqrt{d^2+r^2} - d + \frac{(-r)\times(l\cos\theta - R)}{\sqrt{l^2+R^2-2lR\cos\theta}}\right] \quad (1)$$

$$r_s = \frac{l\cos\theta}{R}r \quad (2)$$

$$\varphi_2(f) = 2\pi\frac{f}{c}\left[\sqrt{(x-r_s)^2+y^2+\left(\frac{lr\sin\theta}{R}\right)^2} - \sqrt{(r-r_s)^2+\left(\frac{lr\sin\theta}{R}\right)^2}\right] \quad (3)$$

$$\varphi(f) = \mathrm{mod}[(\varphi_1+\varphi_2), 2\pi] \quad (4)$$

Where d is the distance between the phase center of the feeding horn and the center of the beam-forming plane; x and y are the coordinates of the center point of each mesh, so $r=\sqrt{x^2+y^2}$ is the distance between the center point of each mesh and the center of the beam-forming plane; φ(f) is the ideal phase shift amount of the beam-forming unit in each mesh; f is the operating frequency; c is the free-space speed of light; l is the non-diffractive distance of the Bessel beam; θ is the angle between the Bessel beam and the beam-forming plane; R is the radius of the beam-forming plane 1, and mod is the remainder function.

According to the different position (x, y) of each beam-forming unit, the ideal phase shift amount of each beam-forming unit on the beam-forming plane 1 is calculated according to the formulas (1)-(4), then according to the ideal phase shift amount, the beam-forming unit is selected and arranged on the beam-forming plane 1, thus a phase distribution that satisfies a Bessel distribution on an exit face of the beam-forming plane 1 is generated to generate bunched non-diffracted electromagnetic waves.

The beam pointing of the beam-forming non-diffracted electromagnetic wave depends on the parameter θ in the formulas, changing the value of θ in the design can achieve different-directed Bessel beams; the beaming range of the bunched electromagnetic wave depends on the parameter l in the formulas, changing the value of l in the design can achieve bunched electromagnetic waves of different depth of field (beaming range). The dielectric substrate should be a plate with low loss, low dielectric constant, and stable high frequency performance.

The ideal phase shift amount φ(f) in (4) is the theoretical phase shift difference between each position and the position at the center of the beam-forming plane. In order to improve the bunching efficiency, the unit with the phase shift amount of −270 degrees is placed in the center of the plane. So, the actual phase shift amount in this embodiment is:

$$\theta_{preal}(f)=\mathrm{int}\{[\varphi(f)-270°]/90\}\times90$$

where int is the rounding down function. By changing the side length of the three-layer metal patches in each mesh, the phase requirement of the Bessel beam at the exit surface of the beam-forming plane can be satisfied. The sizes of the metal patches corresponding to the four phase shift amplitudes are obtained in the Ansys HFSS full-wave simulation software through the periodic boundary conditions. In this embodiment, the relationship between the phase shift amount and the side length of the metal patch is as Table 1:

TABLE 1

The relationship between the phase shift amount and the side length of the metal patch

| Side length of the metal patch (mm) | Phase shift amount | | | |
|---|---|---|---|---|
| | 0° | −90° | −180° | −270° |
| Upper layer and bottom layer metal patch | 0 | 1.6 | 1.75 | 1.8 |
| Middle layer metal patch | 0 | 1.6 | 1.85 | 1.95 |

Thus, the design of the beam-forming plane can be completed. Then, on the left side of the beam-forming plane, a linear polarization cone horn 2 with a gain of 12.5 dB and a −10 dB beam width of 60 degrees is applied, and the horn is facing the center of the beam-forming plane, as shown in FIG. 1, linearly polarized Bessel beams can be generated on the right side of the beam-forming plane.

Figure 9:
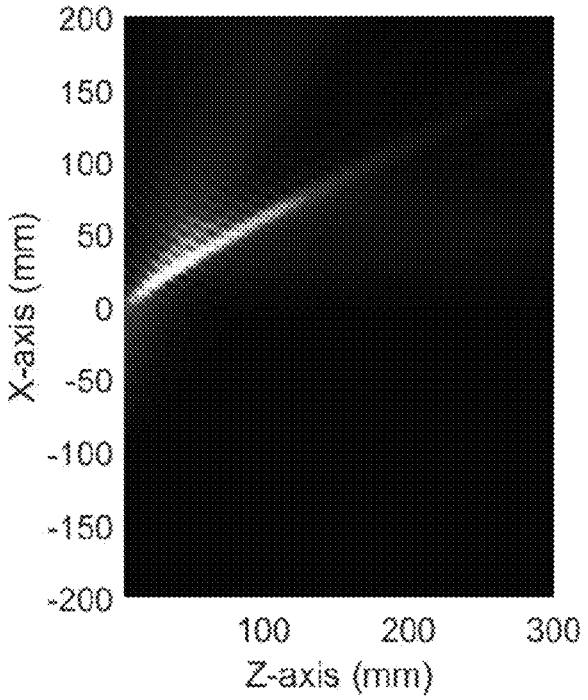
FIG. 9 is a non-diffracting beam-forming beam effect diagram of Embodiment 1.
Figure 10A:
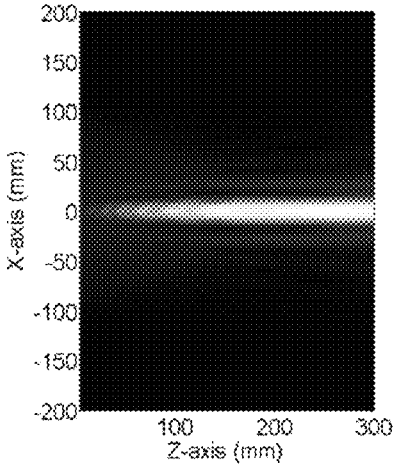
FIG. 10A is a first scannable non-diffracting beamforming effect diagram of Embodiment 2. The corresponding parameters are as follows: $\alpha=90°$, $\beta=0°$, $\alpha$ is the relative rotation angle between the beam-forming plane and the feeding horn, $\beta$ is the inclination angle of the corresponding beam.
Figure 10B:
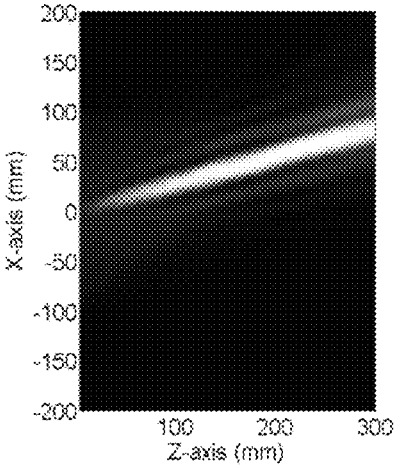
FIG. 10B is a second scannable non-diffracting beamforming effect diagram of Embodiment 2. The corresponding parameters are as follows: $\alpha=75°$, $\beta=15°$; $\alpha$ is the relative rotation angle between the beam-forming plane and the feeding horn, $\beta$ is the inclination angle of the corresponding beam.
Figure 10C:
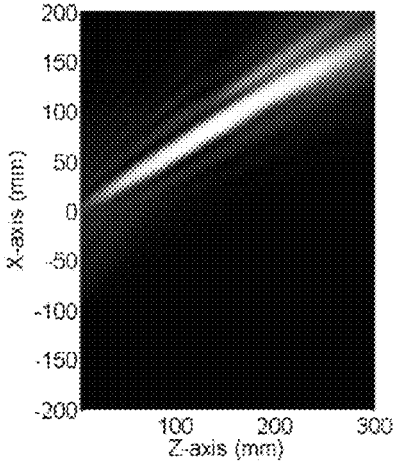
FIG. 10C is a third scannable non-diffracting beamforming effect diagram of Embodiment 2. The corresponding parameters are as follows: $\alpha=60°$, $\beta=30°$; $\alpha$ is the relative rotation angle between the beam-forming plane and the feeding horn, $\beta$ is the inclination angle of the corresponding beam.
Figure 10D:
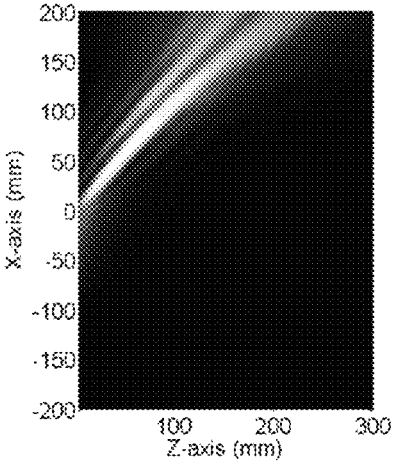
FIG. 10D is a fourth scannable non-diffracting beamforming effect diagram of Embodiment 2. The corresponding parameters are as follows: $\alpha=45°$, $\beta=45°$; $\alpha$ is the relative rotation angle between the beam-forming plane and the feeding horn, $\beta$ is the inclination angle of the corresponding beam.
Figure 10E:
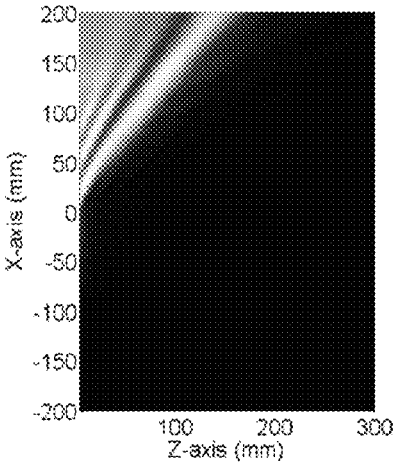
FIG. 10E is a fifth scannable non-diffracting beamforming effect diagram of Embodiment 2. The corresponding parameters are as follows: $\alpha=30°$, $\beta=53°$; $\alpha$ is the relative rotation angle between the beam-forming plane and the feeding horn, $\beta$ is the inclination angle of the corresponding beam.
Figure 10F:
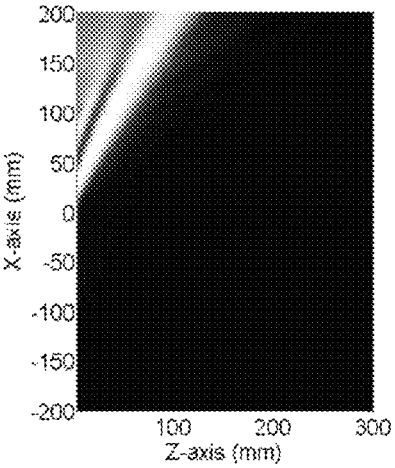
FIG. 10F is a sixth scannable non-diffracting beamforming effect diagram of Embodiment 2. The corresponding parameters are as follows: $\alpha=15°$, $\beta=62°$; $\alpha$ is the relative rotation angle between the beam-forming plane and the feeding horn, $\beta$ is the inclination angle of the corresponding beam.
Figure 10G:
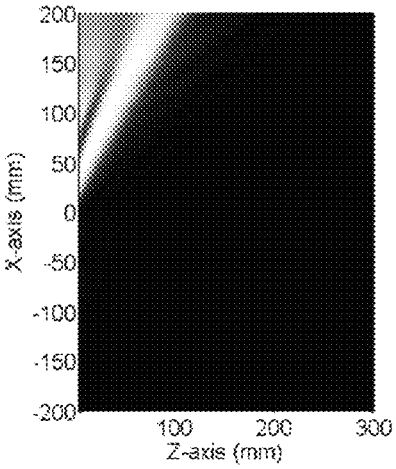
FIG. 10G is a seventh scannable non-diffracting beamforming effect diagram of Embodiment 2. The corresponding parameters are as follows: $\alpha=0°$, $\beta=65°$; $\alpha$ is the relative rotation angle between the beam-forming plane and the feeding horn, $\beta$ is the inclination angle of the corresponding beam.
Figure 11:
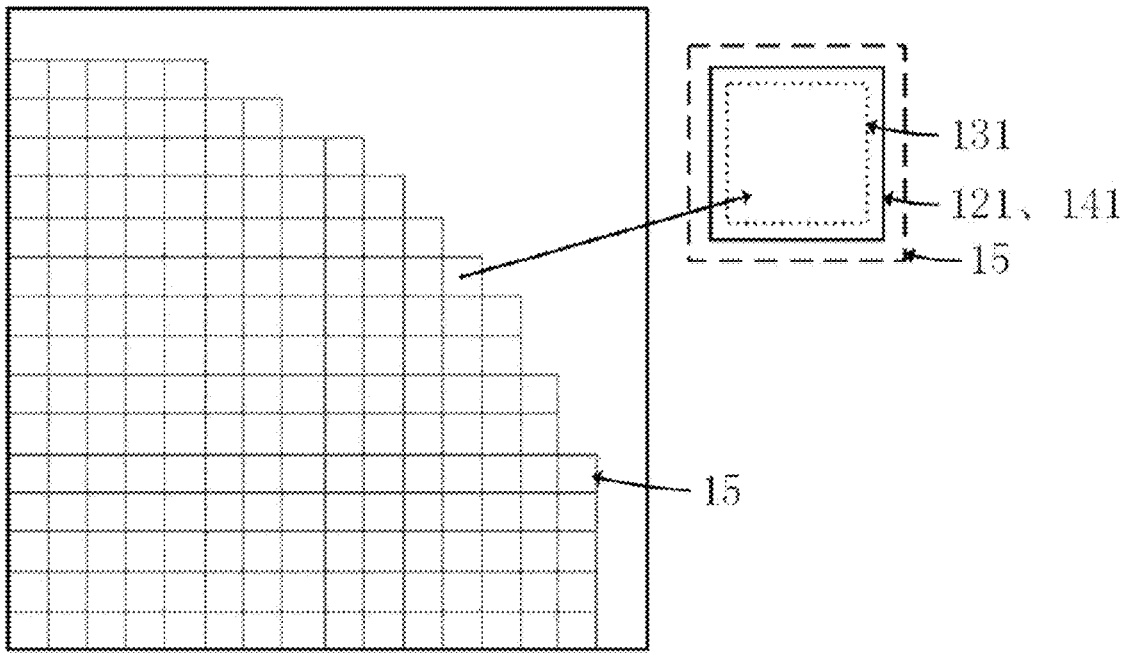
FIG. 11 is a schematic diagram of a case where the meshes on the beam-forming plane of Embodiment 3 are rectangle.

FIG. 9 shows the longitudinal section effect of the Bessel beam intensity generated by the present invention. It can be seen from the figure that the electromagnetic field intensity distribution is beam-like on the propagation axis, and is propagated along the axis with a beam pointing angle θ of 60°. The field intensity remained basically unchanged in the range of the depth-of-field, which indicates that the beaming performance is good and the design expectations are met.

Embodiment 2

In this embodiment, a second beam-forming plane 3 is placed behind the beam-forming plane 1, the second beam-forming plane 3 and beam-forming plane 1 have the same structure, and are coaxially stacked. Changing the relative angle of the second beam-forming plane 3 and beam-forming plane 1 by rotating to achieve a scanning of beam pointing angel θ.

The beam-forming plane 1 and the second beam-forming plane 3 have the same structure, however, the only difference between the beam-forming plane 1 and the second beam-forming plane 3 is that distributions of the beam-forming unit in the printed circuit bottom layer 14, the printed circuit middle layer 13 and the printed circuit upper layer 12 on the second beam-forming plane 3 are different.

Figure 8:
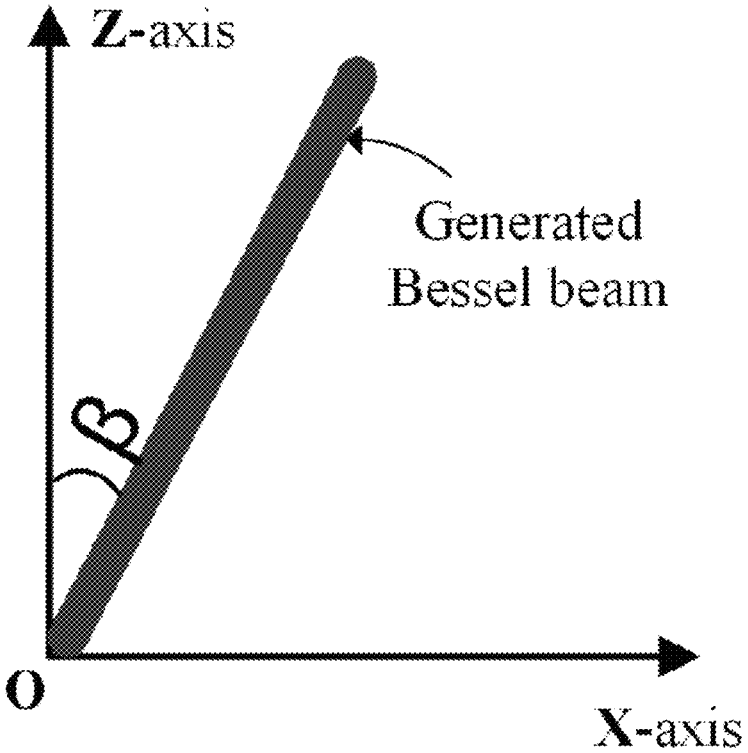
FIG. 8 is a schematic diagram of the beam-forming beam pointing according to the present invention, which applies the same coordinate system as FIG. 6.

The ideal phase shift amount φ(f) of the beam-forming unit in the mesh divided by the second beam-forming plane 3 is calculated by formulas (5) to (8):

$$\varphi_1(f) = \frac{2\pi \times f \times (-r) \times (l\cos\theta - R)}{c \times \sqrt{l^2 + R^2 - 2lR\cos\theta}} \tag{5}$$

$$r_s = \frac{l\cos\theta}{R} r \tag{6}$$

$$\varphi_2(f) = 2\pi\frac{f}{c}\left[\sqrt{(x - r_s)^2 + y^2 + \left(\frac{lr\sin\theta}{R}\right)^2} - \sqrt{(r - r_s)^2 + \left(\frac{lr\sin\theta}{R}\right)^2}\right] \tag{7}$$

$$\varphi(f) = \mathrm{mod}[(\varphi_1 + \varphi_2), 2\pi] \tag{8}$$

where x and y are the coordinates of the center point of each mesh, so $r=\sqrt{x^2+y^2}$ is the distance between the center point of each mesh and the center of the beam-forming plane; φ(f) is the ideal phase shift amount of the beam-forming unit in each mesh; f is the operating frequency; c is the free-space speed of light; l is the non-diffractive distance of the Bessel beam; θ controls the beam scanning range, θ/2 is about the minimum value of angle between the Bessel beam and the beam-forming plane during the scanning. So, the scanning range of the tilted angel β of the beam, as shown in FIG. 8, is about 0°-(90°-θ/2); R is the radius of the beam-forming plane 1, and mod is the remainder function.

Thus, according to a different mesh position (x, y) of each beam-forming unit, the ideal phase shift amount of each beam-forming unit on the second beam-forming plane 3 is calculated by the formulas (5)-(8), then, according to the ideal phase shift amount, a suitable sized beam-forming unit is selected and arranged on the second beam-forming plane 3 to obtain a final design structure of the second beam-forming plane 3.

Figure 6:
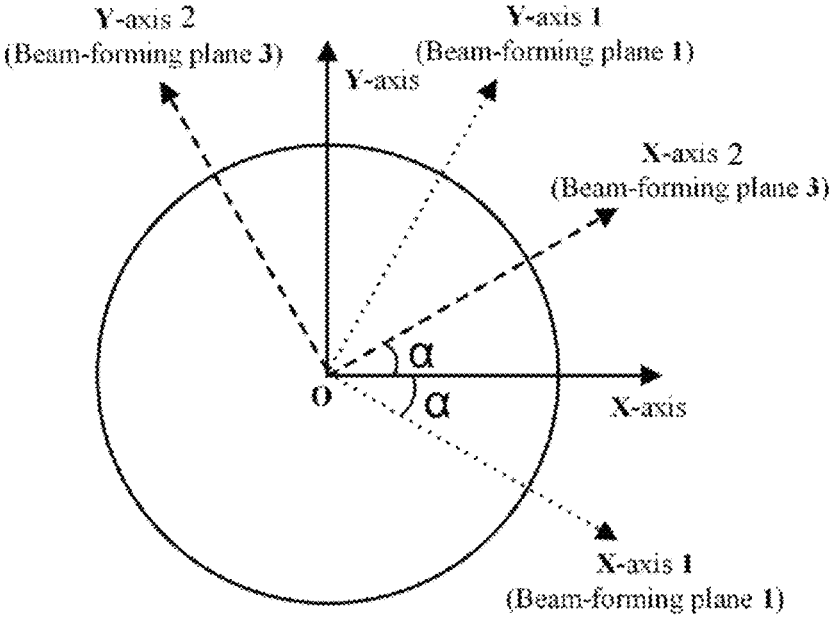
FIG. 6 is a schematic diagram of relative rotation positions of the antenna beam-forming plane and the second beam-forming plane according to Embodiment 2 of the present invention.
Figure 7:
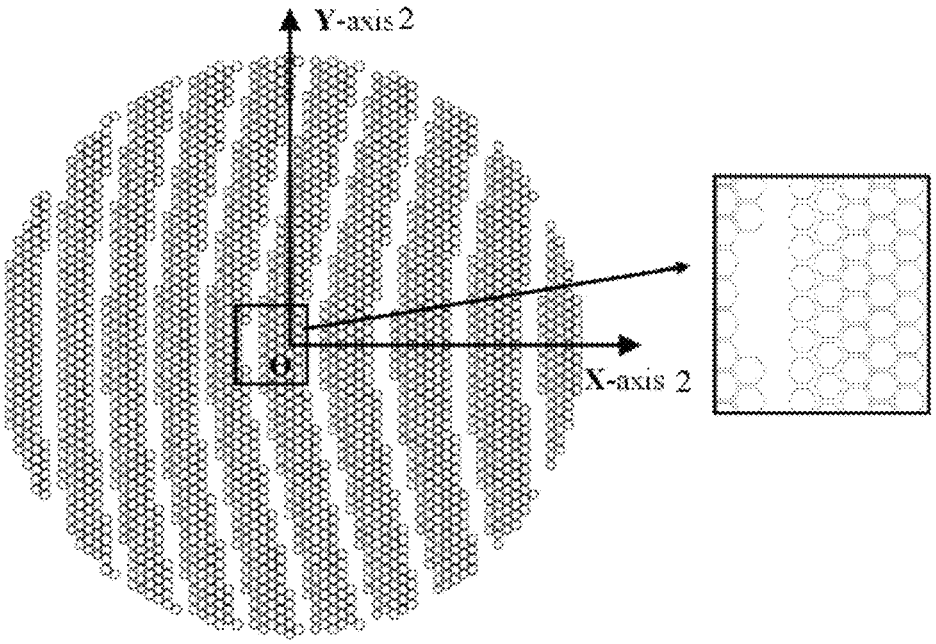
FIG. 7 is a front view of the second beam-forming plane according to the present invention.

The beam scanning is achieved by rotating the beam-forming plane 1 and the second beam-forming plane 3. Changing the rotation angle a can generate non-diffracted beams with different inclination angles β along the X-axis, as shown in FIG. 6. The corresponding relationship between the rotation angle a and the inclination angles β is shown in Table 2.

TABLE 2

The corresponding relationship between the rotation angle α and the inclination angles β

| | α | | | | | | |
|---|---|---|---|---|---|---|---|
| | 90° | 75° | 60° | 45° | 30° | 15° | 0° |
| β | 0° | 15° | 30° | 45° | 53° | 62° | 65° |

FIG. 10A, FIG. 10B, FIG. 10C, FIG. 10D, FIG. 10E, FIG. 10F and FIG. 10G show the longitudinal section of the Bessel beam intensity generated by this embodiment. It can be seen from the figures that the electromagnetic field intensity distribution is beam-like on the propagation axis, the beam pointing angle θ varies from 0° to 65° by changing the relative angle a between the two beam-forming planes, thus a large range of scanning in the upper half of the beam pointing is achieved and the design expectations are met.

Embodiment 3

Based on Embodiment land Embodiment 2, the regular hexagonal mesh on the beam-forming plane is changed to rectangular mesh, and the upper, middle, and bottom metal patches 121, 131, and 141 are also changed to rectangular patches. In this case, when the feeding horn 2 is transmitting horizontal and vertical polarized waves, the Bessel beams with different depth of field and lobe width can be separately generated. This embodiment also simplifies the structure and reduce the cost, which can be applied to occasions with high requirements of cost control.

Embodiment 4

Based on Embodiment 1 and Embodiment 2, the linear polar pyramid horn 2 is replaced with linear horn, circular horn, elliptical polar pyramid horn or cone horn. Changing the pyramidal horn to a conical horn can increase the axial symmetry of the Bessel beam; changing the linearly polarized horn to a circular or elliptical horn can generate a circular or elliptical Bessel Beam.

The above-described embodiments merely illustrate the principles of the present invention and its effects, but are not intended to limit the present invention. Any person skilled in the art can modify or change the above embodiments without departing from the spirit and scope of the present invention. Therefore, all equivalent modifications or changes made by persons of ordinary skill in the art without departing from the spirit and technical thought disclosed in the present invention shall still be covered by the claims of the present invention.

The invention claimed is:

1. An antenna for generating an arbitrarily directed Bessel beam, comprising:

a beam-forming plane and a feeding horn; wherein, the feeding horn faces a center of the beam-forming plane; the beam-forming plane is a dual-layer dielectric substrate structure having a beam focusing function; the beam-forming plane comprises a printed circuit bottom layer, a high-frequency dielectric substrate lower layer, a printed circuit middle layer, a high-frequency dielectric substrate upper layer, and a printed circuit upper layer; the printed circuit bottom layer, the high-frequency dielectric substrate lower layer, the printed circuit middle layer, the high-frequency dielectric substrate upper layer, and the printed circuit upper layer are co-axially stacked from the bottom to the top: the beam-forming plane is divided into periodically arranged beam-forming units by a plurality of meshes, and each beam-forming unit is comprised of a printed circuit upper metal patch, a printed circuit middle metal patch, a printed circuit lower metal patch, the high-frequency dielectric substrate lower layer and the high-frequency dielectric substrate upper layer; centers of the printed circuit upper metal patch, the printed circuit middle metal patch, and the printed circuit lower metal patch are on a same longitudinal axis; the beam-forming unit is a basic unit having a function of electromagnetic wave phase shifting.

2. The antenna for generating an arbitrarily-directed Bessel beam according to claim 1, wherein an ideal phase shift amount φ(f) of the beam-forming unit on the beam-forming plane is calculated by formulas (1) to (4):

$$\varphi_1(f) = 2\pi\frac{f}{c}\left[\sqrt{d^2+r^2} - d + \frac{(-r)\times(l\cos\theta - R)}{\sqrt{l^2+R^2-2lR\cos\theta}}\right] \quad (1)$$

$$r_s = \frac{l\cos\theta}{R}r \quad (2)$$

$$\varphi_2(f) = 2\pi\frac{f}{c}\left[\sqrt{(x-r_s)^2+y^2+\left(\frac{lr\sin\theta}{R}\right)^2} - \sqrt{(r-r_s)^2+\left(\frac{lr\sin\theta}{R}\right)^2}\right] \quad (3)$$

$$\varphi(f) = \mathrm{mod}[(\varphi_1+\varphi_2), 2\pi] \quad (4)$$

wherein d is a distance between a phase center of the feeding horn and a center of the beam-forming plane; x and y are coordinates of a center point of each mesh, $r=\sqrt{x^2+y^2}$ is a distance between the center point of each mesh and the center of the beam-forming plane; φ(f) is the ideal phase shift amount of the beam-forming unit in each mesh; is an operating frequency; c is a free-space speed of light; l is a non-diffractive distance of the Bessel beam; θ is an angle between the Bessel beam and the beam-forming plane; R is a radius of the beam-forming plane, and mod is a remainder function.

3. The antenna for generating an arbitrarily-directed Bessel beam according to claim 2, wherein according to a different position (x, y) of each beam-forming unit, the ideal phase shift amount of each beam-forming unit on the beam-forming plane is calculated according to formulas (1)-(4), then according to the ideal phase shift amount, the beam-forming unit is selected and arranged on the beam-forming plane, wherein a phase distribution for a Bessel distribution on an exit face of the beam-forming plane is generated to generate bunched non-diffracted electromagnetic waves.

4. The antenna for generating an arbitrarily-directed Bessel beam according to claim 1, wherein sizes of the metal patches in the beam-forming unit corresponding to different phase shift amounts are obtained in a full wave simulation software through periodic boundary conditions.

5. The antenna for generating an arbitrarily-directed Bessel beam according to claim 1, wherein the meshes are rectangular or hexagonal; when the meshes are rectangular, the beam-forming units are arranged in a square mesh, and when the meshes are hexagonal, the beam-forming units are arranged in a honeycomb mesh.

6. The antenna for generating an arbitrarily-directed Bessel beam according to claim 1, wherein the feeding horn is a linearly polarized, circularly polarized or multi-polarized horn.

7. The antenna for generating an arbitrarily-directed Bessel beam according to claim 1, wherein a second beam-forming plane is arranged behind the beam-forming plane; the second beam-forming plane and the beam-forming plane have the same structure, and are coaxially stacked; a relative angle of the second beam-forming plane and the beam-forming plane is changed by rotating to achieve a scanning of beam pointing angel θ.

8. The antenna for generating an arbitrarily-directed Bessel beam according to claim 1, wherein only difference between the second beam-forming plane and the beam-forming plane is that distribution of the beam-forming units in the printed circuit bottom layer, the printed circuit middle layer and the printed circuit upper layer on the second beam-forming plane are different;

an ideal phase shift amount φ(f) of the beam-forming unit in the mesh divided by the second beam-forming plane is calculated by formulas (5) to (8):

$$\varphi_1(f) = \frac{2\pi\times f\times(-r)\times(l\cos\theta - R)}{c\times\sqrt{l^2+R^2-2lR\cos\theta}} \quad (5)$$

$$r_s = \frac{l\cos\theta}{R}r \quad (6)$$

$$\varphi_2(f) = 2\pi\frac{f}{c}\left[\sqrt{(x-r_s)^2+y^2+\left(\frac{lr\sin\theta}{R}\right)^2} - \sqrt{(r-r_s)^2+\left(\frac{lr\sin\theta}{R}\right)^2}\right] \quad (7)$$

$$\varphi(f) = \mathrm{mod}[(\varphi_1+\varphi_2), 2\pi] \quad (8)$$

wherein x and y are coordinates of a center point of each mesh, so $r=\sqrt{x^2+y^2}$ is a distance between the center point of each mesh and a center of the beam-forming plane; φ(f) is the ideal phase shift amount of the beam-forming unit in each mesh; f is an operating frequency; c is a free-space speed of light; l is a non-diffractive distance of the Bessel beam; θ controls the beam scanning range; θ/2 is about a minimum value of an angle between the Bessel beam and the beam-forming plane during the scanning; R is a radius of the beam-forming plane, and mod is a remainder function;

wherein according to a different mesh position (x, y) of each beam-forming unit, the ideal phase shift amount of each beam-forming unit on the second beam-forming plane is calculated according to the formulas (5)-(8); then, according to the ideal phase shift amount, a suitable sized beam-forming unit is selected and arranged on the second beam-forming plane to obtain a final design structure of the second beam-forming plane.

* * * * *